US008875672B2

(12) United States Patent
Uzkan

(10) Patent No.: US 8,875,672 B2
(45) Date of Patent: Nov. 4, 2014

(54) ENGINE SYSTEM HAVING DEDICATED CYLINDER-TO-CYLINDER CONNECTION

(75) Inventor: Teoman Uzkan, Indian Head Park, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 306 days.

(21) Appl. No.: 13/407,173

(22) Filed: Feb. 28, 2012

(65) Prior Publication Data

US 2013/0220245 A1 Aug. 29, 2013

(51) Int. Cl.
*F02B 25/26* (2006.01)
*F02B 75/18* (2006.01)

(52) U.S. Cl.
CPC ..... *F02B 25/26* (2013.01); *F02B 75/18* (2013.01)
USPC ..... 123/52.1

(58) Field of Classification Search
CPC ..... F02B 25/26; F02B 75/18; F02B 75/20; F02B 75/22; F02B 1/00; F02B 27/00; F02B 27/04; F02B 29/00
USPC ..... 123/52.1, 58.1, 58.7, 58.8, 65 A, 568.11, 123/662
See application file for complete search history.

(56) References Cited

U.S. PATENT DOCUMENTS

| | | | | |
|---|---|---|---|---|
| 3,805,752 | A * | 4/1974 | Cataldo | 123/26 |
| 4,282,845 | A | 8/1981 | Nohira et al. | |
| 4,671,226 | A | 6/1987 | van Rinsum | |
| 5,010,860 | A * | 4/1991 | Broussard | 123/256 |
| 6,192,858 | B1 | 2/2001 | Nieberding | |
| 6,382,193 | B1 * | 5/2002 | Boyer et al. | 123/560 |
| 6,543,398 | B1 * | 4/2003 | Roberts et al. | 123/58.8 |
| 6,722,127 | B2 | 4/2004 | Scuderi et al. | |
| 6,769,393 | B2 | 8/2004 | Widener et al. | |
| 6,925,979 | B1 | 8/2005 | Seitz | |
| 7,028,648 | B2 | 4/2006 | Hasegawa et al. | |

(Continued)

FOREIGN PATENT DOCUMENTS

| | | |
|---|---|---|
| GB | 2009316 | 6/1979 |
| JP | 54-77828 | 6/1979 |

OTHER PUBLICATIONS

U.S. Patent Application by Teoman Uzkan entitled "Engine System Having Dedicated Auxiliary Connection to Cylinder" filed on Feb. 28, 2012.

(Continued)

*Primary Examiner* — Noah Kamen
*Assistant Examiner* — Grant Moubry
(74) *Attorney, Agent, or Firm* — Finnegan, Henderson, Farabow, Garrett & Dunner LLP

(57) ABSTRACT

An system is disclosed for use with an engine. The system may have an intake manifold configured to direct air into combustion chambers of the engine, and an exhaust manifold configured to direct exhaust from the combustion chambers to the atmosphere. The system may also have at least one conduit extending from a first of the combustion chambers to a second of the combustion chambers, and at least one valve associated with the at least one conduit. The at least one valve is configured to pass fluid from the first of the combustion chamber to the second of the combustion chambers during a compression stroke of a first piston within the first of the combustion chambers and during an expansion stroke of a second piston within the second of the combustion chambers.

20 Claims, 3 Drawing Sheets

(56) References Cited

U.S. PATENT DOCUMENTS

| | | | | |
|---|---|---|---|---|
| 7,461,619 | B2 * | 12/2008 | Price | 123/90.11 |
| 7,472,696 | B2 | 1/2009 | Easley et al. | |
| 7,484,498 | B2 * | 2/2009 | Hitomi et al. | 123/406.45 |
| 7,556,028 | B2 * | 7/2009 | Higaki et al. | 123/568.13 |
| 7,607,503 | B1 * | 10/2009 | Schechter | 180/165 |
| 7,784,443 | B2 * | 8/2010 | Hitomi et al. | 123/406.47 |
| 8,091,520 | B2 * | 1/2012 | Phillips | 123/70 R |
| 2007/0272221 | A1 | 11/2007 | Branyon et al. | |
| 2009/0056670 | A1 * | 3/2009 | Zhao et al. | 123/25 P |
| 2010/0024419 | A1 | 2/2010 | Pierpont et al. | |

OTHER PUBLICATIONS

U.S. Patent Application by Teoman Uzkan entitled "Engine System Having Dedicated EGR Cylinder Connection" filed on Feb. 28, 2012.

* cited by examiner

ENGINE SYSTEM HAVING DEDICATED CYLINDER-TO-CYLINDER CONNECTION

TECHNICAL FIELD

The present disclosure is directed to an engine system and, more particularly, to an engine system having a dedicated connection between cylinders.

BACKGROUND

Combustion engines such as diesel engines, gasoline engines, and gaseous fuel-powered engines are supplied with a mixture of air and fuel for combustion within the engine that generates a mechanical power output and a flow of exhaust gases. The exhaust gases produced by the engine can contain a complex mixture of air pollutants generated as byproducts of the combustion process. For example, the exhaust gases can include a high concentration of NOx when the combustion process generates temperatures greater than about 1500° F.

Due to increased attention on the environment, exhaust emission standards have become more stringent and the amount of pollutants emitted to the atmosphere from an engine can be regulated depending on the type of engine, size of engine, and/or class of engine. For this reason, engine manufacturers have implemented a variety of different methods for reducing the type and/or amount of pollutants generated by the engine. One method used by some manufacturers includes reducing combustion temperatures of the engine below the threshold temperature at which NOx formation occurs.

An exemplary NOx-reducing system is disclosed in U.S. Pat. No. 7,028,648 that issued to Hasegawa et al. on Apr. 18, 2006 ("the '648 patent"). In particular, the '648 patent discloses a system for an engine having a plurality of cylinders sharing a single crankshaft. Combustion characteristics of the cylinders are improved by taking out gas from an expanding cylinder and directing the gas into a compressing cylinder. This flow of gas between cylinders is facilitated by way of a dedicated conduit and cam-operated valves associated with each cylinder. By taking out gas from the expanding cylinder at a time of highest temperature, the overall temperature of that cylinder is reduced, thereby also reducing an amount of NOx formed within the cylinder. In addition, by directing the removed gases into the compressing cylinder, a greater power output can be subsequently generated by the compressing cylinder.

Although the system in the '648 patent may help to lower NOx production, it may also be problematic. In particular, the gases being transferred between cylinders include burned or partially burned molecules (soot and particulate matter), which can clog the conduit and/or associated valves. In addition, the transferred gases are at an elevated temperature, which could result in excessive NOx production by the cylinder receiving the gases. Further, it may be difficult to precisely time opening of the gas-transferring valves at peak combustion such that pressures and/or temperatures in the donating cylinder are maintained at desired levels.

The disclosed engine system is directed to overcoming one or more of the problems set forth above and/or other problems of the prior art.

SUMMARY

In one aspect, the disclosure is directed toward an engine system. The engine system may include an intake manifold configured to direct air into combustion chambers of the engine, and an exhaust manifold configured to direct exhaust from the combustion chambers to the atmosphere. The engine system may also include at least one conduit extending from a first of the combustion chambers to a second of the combustion chambers, and at least one valve associated with the at least one conduit. The at least one valve is configured to pass fluid from the first of the combustion chamber to the second of the combustion chambers during a compression stroke of a first piston within the first of the combustion chambers and during an expansion stroke of a second piston within the second of the combustion chambers.

In another aspect, the disclosure is directed toward a method of operating an engine. The method may include compressing air, and directing compressed air through an intake manifold into a plurality of combustion chambers. The method may also include directing exhaust from the plurality of combustion chambers through an exhaust manifold to the atmosphere. The method may further include directing fluid from a first of the plurality of combustion chamber through at least one conduit to a second of the plurality of combustion chambers when a first piston associated with the first of the plurality of combustion chambers is moving through a compression stroke and a second piston associated with the second of the plurality of combustion chambers is moving through an expansion stroke.

DETAILED DESCRIPTION

Figure 1:
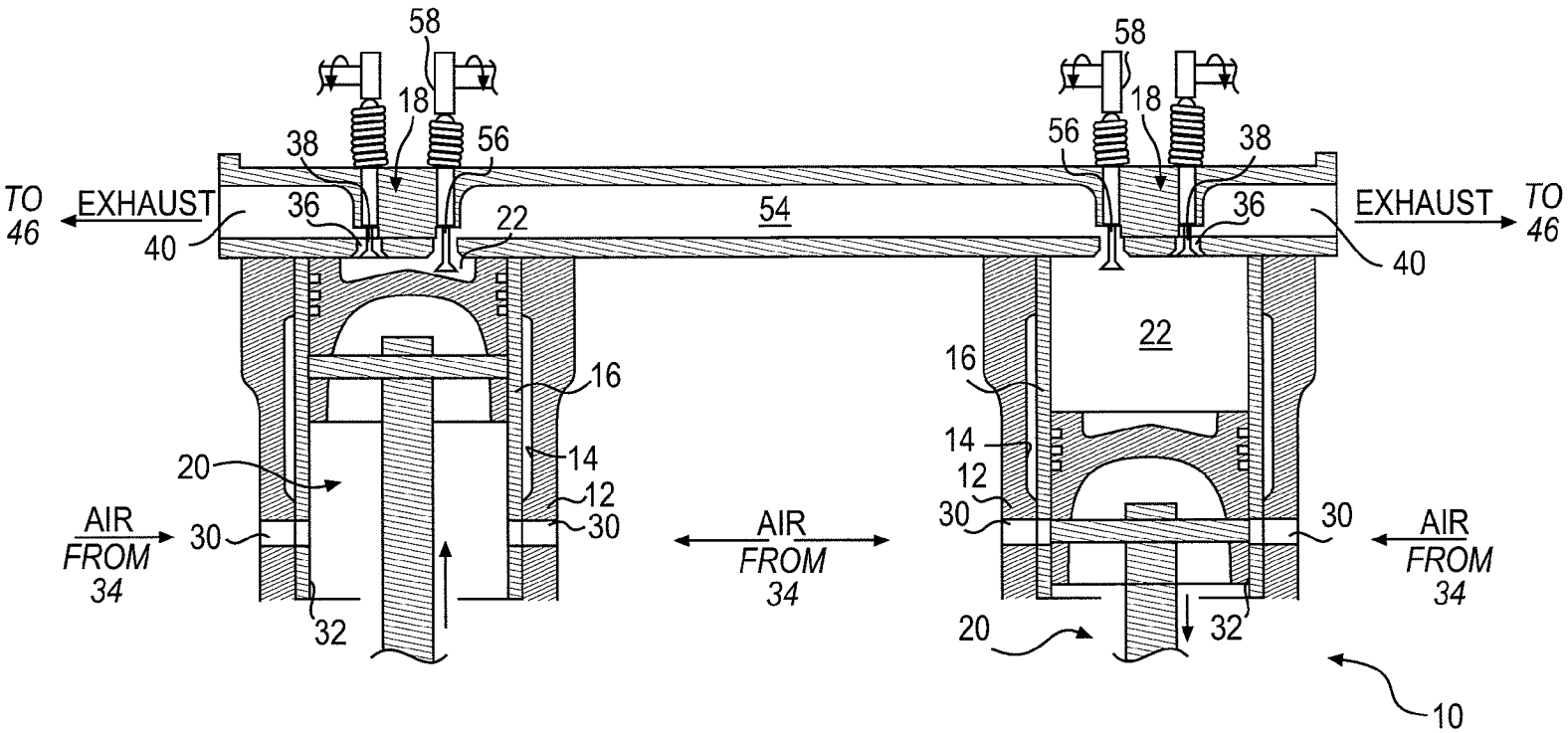
FIG. 1 is a cross-sectional illustration of an exemplary disclosed engine.

An exemplary internal combustion engine 10 is illustrated in FIG. 1. Engine 10 is depicted and described as a two-stroke diesel engine. However, it is contemplated engine 10 may be another type of internal combustion engine such as, for example, a four-stroke diesel engine, a two- or four-stroke gasoline engine, or a two- or four-stroke gaseous fuel-powered engine, if desired. Engine 10 may include, among other things, an engine block 12 that at least partially defines a cylinder 14, a liner 16 disposed within cylinder 14, and a cylinder head 18 connected to engine block 12 to close off an end of liner 16. A piston 20 may be slidably disposed within liner 16 and, together with liner 16 and cylinder head 18, define a combustion chamber 22. It is contemplated that engine 10 may include any number of combustion chambers 22 and that combustion chambers 22 may be disposed in an "in-line" configuration (shown in FIG. 1), in a "V" configuration, in an opposing-piston configuration, or in any other conventional configuration.

Piston 20 may be configured to reciprocate between a bottom-dead-center (BDC) or lower-most position within liner 16, and a top-dead-center (TDC) or upper-most position. In particular, piston 20 may be pivotally connected to a crankshaft (not shown) and the crankshaft may be rotatably disposed within engine block 12 so that a sliding motion of each piston 20 within liner 16 results in a rotation of the crankshaft. Similarly, a rotation of the crankshaft may result in a sliding motion of piston 20. As the crankshaft rotates through about 180 degrees, piston 20 may move through one full stroke between BDC and TDC. Engine 10, as a two-stroke engine, may have a complete cycle that includes a power(expansion)/exhaust/intake stroke (TDC to BDC) and an intake/compression stroke (BDC to TDC).

During a final phase of the power(expansion)/exhaust/intake stroke described above, air may be drawn and/or forced into combustion chamber 22 via one or more gas exchange ports (e.g., intake ports) 30 located within an annular surface 32 of liner 16. In particular, as piston 20 moves downward within liner 16, a position will eventually be reached at which intake ports 30 are no longer blocked by piston 20 and instead are fluidly communicated with combustion chamber 22. When intake ports 30 are in fluid communication with combustion chamber 22 and a pressure of air at intake ports 30 is greater than a pressure within combustion chamber 22, air will pass from an intake manifold (or other intake duct) 34 through intake ports 30 into combustion chamber 22. The timing at which intake ports 30 are opened (i.e., unblocked by piston 20 and fluidly communicated with combustion chamber 22) may have an effect on a pressure gradient between intake ports 30 and combustion chamber 22 and/or an amount of air that passes into combustion chamber 22 before intake ports 30 are subsequently closed by the ensuing upward movement of piston 20. The opening and/or closing timings of intake ports 30 may also have an effect on a temperature of the air directed into combustion chamber 22. Fuel may be mixed with the air before, during, or after the air is drawn into combustion chamber 22.

During the beginning of the intake/compression stroke described above, air may still be entering combustion chamber 22 via intake port 30 and piston 20 may be starting its upward stroke to mix the fuel and air within combustion chamber 22. Eventually, intake port 30 may be blocked by piston 20 and further upward motion of piston 20 may compress the mixture. As the mixture within combustion chamber 22 is compressed, the pressure and temperature of the mixture will increase. Eventually, the pressure and temperature of the mixture will reach a point at which the mixture combusts, resulting in a release of chemical energy in the form of pressure and temperature spikes within combustion chamber 22. In fuel-injected engines, initiation of combustion may start at or after the start of fuel injection.

During a first phase of the power(expansion)/exhaust/intake stroke, the pressure spike within combustion chamber 22 may force piston 20 downward, thereby expanding the volume of combustion chambers 22 and imparting mechanical power to the crankshaft. At a particular point during this downward travel, one or more gas exchange ports (e.g., exhaust ports) 36 located within cylinder head 18 may open to allow pressurized exhaust within combustion chamber 22 to exit. In particular, as piston 20 moves downward within liner 16, a position will eventually be reached at which exhaust valves 38 move to fluidly communicate combustion chamber 22 with exhaust ports 36. When combustion chamber 22 is in fluid communication with exhaust ports 36 and a pressure of exhaust gas in combustion chamber 22 is greater than a pressure within exhaust ports 36, exhaust gas will pass from combustion chamber 22 through exhaust ports 36 into an exhaust manifold 40. The timing at which exhaust valves 38 move to open exhaust ports 36 may have an effect on a pressure gradient between combustion chamber 22 and exhaust ports 36 and/or an amount of exhaust that passes from combustion chamber 22 before exhaust ports 36 are subsequently closed by exhaust valves 38. The opening and/or closing timings of exhaust ports 36 may also have an effect on a gas temperature within combustion chamber 22. In the disclosed embodiment, movement of exhaust valves 38 may be cyclically controlled by way of a cam that is mechanically linked to the crankshaft. It is contemplated, however, that movement of exhaust valves 38 may be controlled in any other conventional manner, as desired. It is also contemplated that exhaust ports 36 could alternatively be located within cylinder liner 16 and exhaust valves 38 omitted, if desired, such as in a loop-scavenged two-cycle engine.

Figure 2:
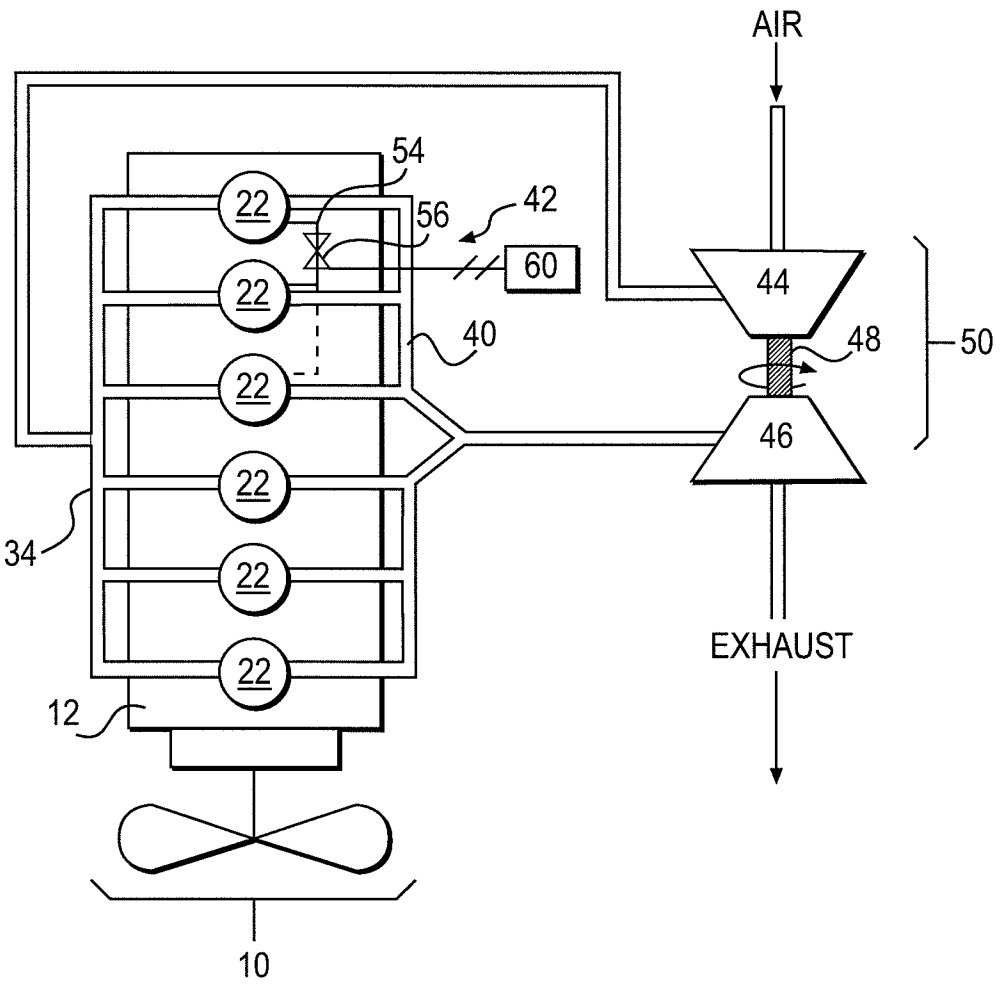
FIG. 2 is a diagrammatic illustration of an exemplary disclosed system that may be used in conjunction with the engine of FIG. 1.

As shown in FIG. 2, engine 10 may be equipped with components configured to introduce charged air into engine 10 and discharge exhaust to the atmosphere. For example, engine 10 may include one or more air compressors 44 in fluid communication with combustion chambers 22 via intake manifold 34, and one or more turbines 46 propelled by exhaust from exhaust manifold 40 to drive compressors 44. Each compressor 44 may embody a fixed geometry compressor, a variable geometry compressor, or any other type of compressor configured to draw air from the atmosphere and compress the air to a predetermined pressure level before it enters engine 10. Turbines 46 may be directly and mechanically connected to compressors 26 by way of a shaft 48 to form a turbocharger 50. As the hot exhaust gases exiting engine 10 move through turbines 46 and expand against blades (not shown) therein, turbines 46 may rotate and drive the connected compressors 26 to pressurize inlet air.

After passing through turbines 46, the exhaust may first be treated before being released back to the atmosphere. In particular, one or more exhaust treatment devices (not shown) may be located to receive the exhaust from turbine 46. The exhaust treatment devices may include, for example, a particulate filter, one or more catalysts, or another treatment device known in the art. The exhaust treatment devices may be configured to remove, trap, reduce, or otherwise convert pollutants in the exhaust flow of engine 10 to innocuous substances.

Engine 10 may be equipped with a system 42 that is configured to selectively and fluidly communicate one combustion chamber 22 directly with another combustion chambers 22. Specifically, system 42 may include a conduit 54 that is connected between fewer than all of combustion chambers 22 in a manner separate from intake and exhaust manifolds 34, 40. In the disclosed embodiment, conduit 54 is connected between only two combustion chambers 22. It should be noted, however, that conduit 54 may alternatively be connected between three or more combustion chambers 22 and/or that multiple conduits 54 may separately connect different pairings and/or groupings of combustion chambers 22, if desired. At least one valve 56 may be associated with conduit 54 and configured to control fluid flow through conduit 54.

Returning to FIG. 1, one valve 56 is shown as being disposed within each cylinder head 18, together with exhaust valve 38, at opposing ends of conduit 54. Each valve 56, in this embodiment, may be a mechanically-actuated valve caused to move between a flow-blocking position and a flow-passing position by a cam 58 that is driven by the crankshaft of engine 10. Cam 58 may be associated with only one valve 56 or multiple valves 56, such that valves 56 may be operated independently and separately from exhaust valves 38 and intake ports 30. Each valve 56 may be spring-biased toward the flow-blocking position.

FIG. 2 illustrates an alternative embodiment of valve 56. In this embodiment, valve 56 may be an electronically-actuated valve that is selectively caused to move to any position between the flow-blocking and flow-passing positions by a controller 60. In this embodiment, controller 60 may be capable of moving valve 56 toward the flow-passing position such that a desired amount or flow-rate of fluid at a desired temperature and/or pressure may be pushed from one combustion chamber 22 to another combustion chamber 22 via conduit 54.

Controller 60 may embody a single or multiple microprocessors, field programmable gate arrays (FPGAs), digital signal processors (DSPs), etc. that include a means for controlling an operation of system 42. Numerous commercially available microprocessors can be configured to perform the functions of controller 60. It should be appreciated that controller 60 could readily embody a microprocessor separate from that controlling other non-exhaust related functions, or that controller 60 could be integral with a general engine microprocessor and be capable of controlling numerous engine functions and modes of operation. If separate from a general engine microprocessor, controller 60 may communicate with the general engine microprocessor via data links or other methods. Various other known circuits may be associated with controller 60, including power supply circuitry, signal-conditioning circuitry, actuator driver circuitry (i.e., circuitry powering solenoids, motors, or piezo actuators), communication circuitry, and other appropriate circuitry.

Before, during, and/or after regulating exhaust flow through conduit 54 via valve(s) 56, controller 60 may receive data indicative of an operational condition of engine 10 and/or an actual flow rate, constituency, temperature, and/or pressure of fluid within conduit 54. Such data may be received from another controller or computer (not shown), from sensors strategically located throughout system 42, and/or from a user of engine 10. Controller 60 may then utilize stored algorithms, equations, subroutines, look-up maps and/or tables to analyze the operational condition data and determine a corresponding desired flow rate and/or constituency of fluid within conduit 54 that produces a desired performance of engine 10. Based on the desired flow rate and/or constituency, controller 60 may then cause valve 56 to open at the right timing relative to the strokes of the associated pistons 20 such that the desired flow rate and constituency of fluid is passed therebetween.

Figure 3:
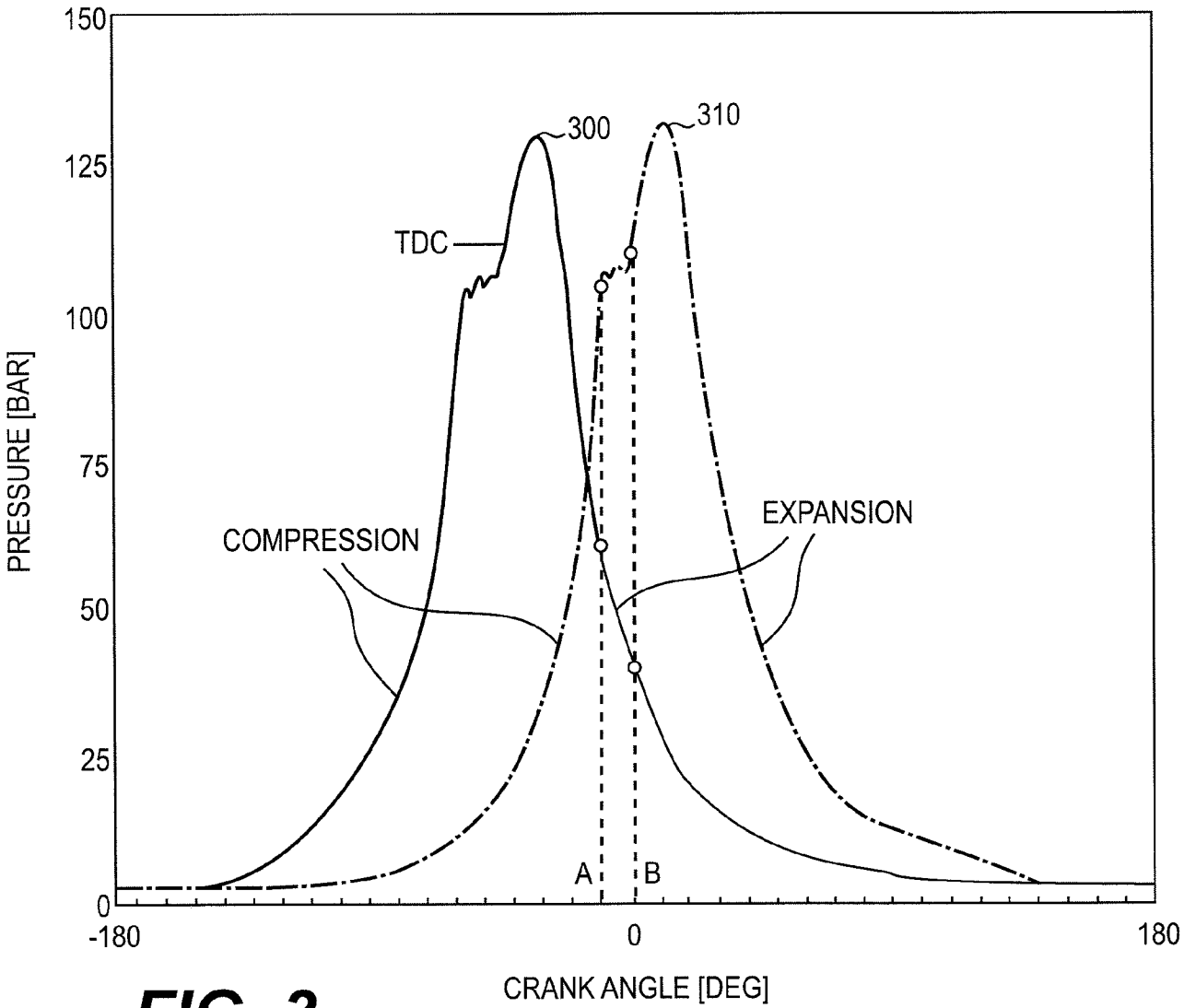
FIG. 3 is a graph depicting an exemplary disclosed operation of the system of FIG. 2.

FIG. 3 is a graph having a first curve 300 associated with movement of a first piston 20 (e.g., the right-most piston shown in FIG. 2), and a second curve 310 associated with movement of a second piston 20 (e.g., the left-most piston shown in FIG. 2). FIG. 3 will be discussed in more detail in the following section to further clarify aspects of this disclosure.

Industrial Applicability

The disclosed system may be applicable to any engine where interconnection between combustion chambers of the engine can enhance operation of the engine. The disclosed system may enhance engine operation by selectively directing air from a compressing combustion chamber to an expanding combustion chamber, thereby reducing a peak temperature of the compressing combustion chamber. When the peak temperature is maintained at a sufficiently low level, for example below about 1500° F., the production of NOx may be reduced. Operation of system 42 will now be described with reference to FIG. 3.

As shown in FIG. 3, curves 300 and 310 may overlap somewhat. In particular, the first piston 20 may be moving downward during a power(expansion)/exhaust/intake stroke at about the same time that the second piston 20 is moving upward during an intake/compression stroke. During a portion of this overlap, for example between about −10 degrees and about 150 degrees in the graph of FIG. 3, pressures within a second combustion chamber 22 corresponding with the second piston 20 may be higher than pressures within a first combustion chamber 22 corresponding with the first piston 20. If valve(s) 56 were to be opened at this time, fluid would flow from the second combustion chamber 22 through conduit 54 into the first combustion chamber 22 due to the pressure differential.

In one embodiment, valve(s) 56 may be controlled to open when the first piston 20 is being propelled downward by expanding combustion gases (i.e., when the first piston 20 is undergoing an expansion stroke—curve 300) at a point A, and again controlled to close toward the end of the expansion stroke at a point B. At this same time, the second piston 20 may be pushing upward to compress air within the second combustion chamber 22 (i.e., the second piston 20 may be moving through a compression stroke—curve 310) and the pressure within the second combustion chamber 22 may be much greater than the pressure within the first combustion chamber 22. The pressure differential between the first and second combustion chambers 22, combined with the current operations of the first and second pistons 20 (i.e., expansion and compression strokes), may cause compressed air (or a compressed mixture of fuel and air) to be pushed from the second combustion chamber 22 into the first combustion chamber 22 via conduit 54. Point A may correspond with about 10 degrees of crank angle before the second piston 20 reaches its TDC position and about 35 degrees of crank angle after the first piston 20 passes through its TDC position. Point B may correspond with about TDC of the second piston 20 and about 55 degrees of crank angle after the first piston 20 passes through its TDC position.

This flow of fluid from the second combustion chamber 22 to the first combustion chamber 22 may reduce a quantity of air (or air and fuel) within the second combustion chamber 22 at the start of combustion. A reduced amount of air (or air and fuel) in the second combustion chamber 22 may result in a reduced combustion temperature and pressure during the following expansion stroke, and a corresponding reduction in the formation of particular pollutants (e.g., NOx). In addition, the flow of compressed air into the first combustion chamber 22 may help to scavenge exhaust from the first combustion chamber 22 as well as increase an exhaust pressure used to drive turbocharger 50.

Several advantages may be associated with the disclosed system 42. In particular, because conduit 54 may be dedicated to facilitating only inter-cylinder fluid communication, characteristics of conduit 54 (e.g., material properties, volume, flow area, etc.) may be selected for optimum performance. In addition, because valve(s) 56 may open during the end of a compression stroke and the end of an expansion stroke, the timing of the opening may be less critical than at other phases of the combustion process. Finally, because the fluid passed between combustion chambers 22 in the disclosed system may consist primarily of air (or air and fuel, but generally not combustion gases), contamination or fouling of system components (e.g., conduit 54, valves 56, etc.) may be unlikely and improved scavenging of the combustion chamber may be attained.

It will be apparent to those skilled in the art that various modifications and variations can be made to the disclosed engine system. Other embodiments will be apparent to those skilled in the art from consideration of the specification and practice of the disclosed engine system. It is intended that the specification and examples be considered as exemplary only, with a true scope being indicated by the following claims and their equivalents.

What is claimed is:

1. An engine system, comprising:

an intake manifold configured to direct air into combustion chambers of an engine;

an exhaust manifold configured to direct exhaust from the combustion chambers to the atmosphere;

at least one conduit extending from a first of the combustion chambers to a second of the combustion chambers, both the first of the combustion chambers and the second of the combustion chambers being configured to combust a fuel air mixture;

at least one valve associated with the at least one conduit; and a controller configured to control the at least one valve to pass fluid from the first of the combustion chambers to the second of the combustion chambers during a compression stroke of a first piston within the first of the combustion chambers and during an expansion stroke of a second piston within the second of the combustion chambers.

2. The engine system of claim 1, wherein the at least one valve includes a first valve associated with the first of the combustion chambers, and a second valve associated with the second of the combustion chambers.

3. The engine system of claim 2, wherein the first and second valves move to flow-passing positions at about the same time.

4. The engine system of claim 3, wherein the first and second valves are configured to be mounted within cylinder heads of the engine.

5. The engine system of claim 4, wherein the first and second valves are configured to be cam-driven.

6. The engine system of claim 5, wherein the first and second valves are configured to be operated independently of intake or exhaust valves of the engine.

7. The engine system of claim 3, wherein the first and second valves move to their flow passing positions when the first piston is nearing an end of the compression stroke and the second piston is nearing an end of the expansion stroke and pressures within the first of the combustion chamber are greater than pressures within the second of the combustion chambers.

8. The engine system of claim 7, wherein the first and second valves move to their flow passing positions when the first piston is about 20-0 degrees of crank angle before top dead center during the compression stroke and the second piston is about 35-55 degrees of crank angle after top dead center during the expansion stroke.

9. The engine system of claim 1, wherein the fluid passed from the first combustion chamber to the second combustion chamber consists primarily of air.

10. The engine system of claim 1, wherein each combustion chamber of the engine is fluidly connected to at least one other combustion chamber of the engine by way of the at least one conduit.

11. The engine system of claim 1, wherein the first combustion chamber is fluidly connected to the second combustion chamber and to at least one other combustion chamber of the engine by way of the at least one conduit.

12. An engine, comprising:

an engine block at least partially defining a plurality of combustion chambers;

at least one intake manifold fluidly connected between the atmosphere and the plurality of combustion chambers;

at least one intake port associated with each of the plurality of combustion chambers and configured to allow a flow of air from the at least one intake manifold into the plurality of combustion chambers;

at least one exhaust manifold fluidly connected between the plurality of combustion chambers of the engine and the atmosphere;

at least one exhaust valve associated with each of the plurality of combustion chambers and selectively movable to allow exhaust to pass from the plurality of combustion chambers into the at least one exhaust manifold;

at least one conduit directly connected between at least a first and a second of the plurality of combustion chambers, both the first and the second of the combustion chambers being configured to combust a fuel air mixture;

at least one valve associated with the at least one conduit; and a controller configured to control the at least one valve to pass fluid from the first of the plurality of the combustion chambers to the second of the plurality of the combustion chambers when a first piston associated with the first of the plurality of combustion chambers is at about 20-0 degrees of crank angle before top dead center during a compression stroke and a second piston associated with the second of the plurality of combustion chambers is at about 35-55 degrees of crank angle after top dead center during an expansion stroke such that air passes from the first of the plurality of combustion chambers to the second of the plurality of combustion chambers.

13. A method of operating an engine, comprising:

compressing air;

directing compressed air through an intake manifold into a plurality of combustion chambers;

directing exhaust from the plurality of combustion chambers through an exhaust manifold to the atmosphere;

directing fluid from a first of the plurality of combustion chambers through at least one conduit to a second of the plurality of combustion chambers when a first piston associated with the first of the plurality of combustion chambers is moving through a compression stroke and a second piston associated with the second of the plurality of combustion chambers is moving through an expansion stroke: and combusting a fuel air mixture in both the first and the second of the plurality of combustion chambers.

14. The method of claim 13, wherein directing air includes simultaneously opening a first valve associated with the first of the plurality of combustion chambers and a second valve associated with the second of the plurality of combustion chambers.

15. The method of claim 14, wherein simultaneously opening the first and second valves includes opening the first and second valves independent of movement of exhaust valves associated with the exhaust manifold.

16. The method of claim 14, wherein simultaneously opening the first and second valves includes opening the first and second valves when the first piston is nearing an end of the compression stroke and the second piston is nearing an end of the expansion stroke.

17. The method of claim 16, wherein simultaneously opening the first and second valves includes opening the first and second valves when the first piston is about 20-0 degrees of crank angle before top dead center and the second piston about 35-55 degrees of crank angle after top dead center.

18. The method of claim 13, wherein the fluid consists primarily of air.

19. The method of claim 13, further including directing fluid from the first of the plurality of combustion chamber through the at least one conduit to a third of the plurality of combustion chambers.

20. The method of claim 13, further including directing fluid from a third of the plurality of combustion chamber through the at least one conduit to a fourth of the plurality of combustion chambers.

* * * * *

UNITED STATES PATENT AND TRADEMARK OFFICE

CERTIFICATE OF CORRECTION

PATENT NO. : 8,875,672 B2
APPLICATION NO. : 13/407173
DATED : November 4, 2014
INVENTOR(S) : Teoman Uzkan It is certified that error appears in the above-identified patent and that said Letters Patent is hereby corrected as shown below:

In the specification

Column 5, line 45, delete "Industrial Applicability" and insert -- INDUSTRIAL APPLICABILITY --.

Signed and Sealed this
Seventeenth Day of November, 2015

Michelle K. Lee

Michelle K. Lee
*Director of the United States Patent and Trademark Office*